US009050701B2

(12) United States Patent
Yamaguchi et al.

(10) Patent No.: US 9,050,701 B2
(45) Date of Patent: Jun. 9, 2015

(54) GRINDING METHOD, GRINDING SYSTEM AND MULTIFUNCTION GRINDING MACHINE

(75) Inventors: Satoshi Yamaguchi, Toyokawa (JP); Yoshihiro Mizutani, Kitanagoya (JP)

(73) Assignee: JTEKT CORPORATION, Osaka-shi (JP)

( * ) Notice: Subject to any disclaimer, the term of this patent is extended or adjusted under 35 U.S.C. 154(b) by 707 days.

(21) Appl. No.: 13/273,483

(22) Filed: Oct. 14, 2011

(65) Prior Publication Data

US 2012/0108146 A1 May 3, 2012

(30) Foreign Application Priority Data

Oct. 27, 2010 (JP) ..... 2010-241141
Oct. 27, 2010 (JP) ..... 2010-241158

(51) Int. Cl.

| | |
|---|---|
| ***B24B 49/02*** | (2006.01) |
| ***B24B 49/14*** | (2006.01) |
| ***B24B 49/16*** | (2006.01) |
| ***B24B 5/42*** | (2006.01) |
| ***B24B 1/00*** | (2006.01) |
| ***B24B 19/12*** | (2006.01) |
| ***B24B 27/00*** | (2006.01) |

(52) U.S. Cl.

CPC . *B24B 49/14* (2013.01); *B24B 1/00* (2013.01); *B24B 19/125* (2013.01); *B24B 27/0061* (2013.01); *B24B 49/16* (2013.01)

(58) Field of Classification Search

USPC ..... 451/5, 9, 10, 11, 49, 51, 57, 62, 246, 451/249, 251

IPC ..... B24B 49/02,49/04, 49/14, 49/16, 51/00, B24B 5/04, 5/42, 19/12, 19/125

See application file for complete search history.

(56) References Cited

U.S. PATENT DOCUMENTS

| | | | | |
|---|---|---|---|---|
| 4,443,976 | A * | 4/1984 | Kaiser, Jr. | 451/228 |
| 4,956,946 | A * | 9/1990 | Tsujiuchi et al. | 451/5 |
| 5,274,961 | A * | 1/1994 | Himmelsbach et al. | 451/547 |

(Continued)

FOREIGN PATENT DOCUMENTS

| | | | |
|---|---|---|---|
| JP | 08-276354 | A | 10/1996 |
| JP | 11-333689 | A | 12/1999 |

(Continued)

OTHER PUBLICATIONS

Notification of Reason(s) for Refusal issued Jul. 1, 2014 in Japanese Patent Application No. 2010-241141 (submitting partial English language translation only).

(Continued)

*Primary Examiner* — Eileen Morgan

(74) *Attorney, Agent, or Firm* — Oblon, McClelland, Maier & Neustadt, L.L.P.

(57) ABSTRACT

A rough grinding process grinds the workpiece W supported by the supporting device by the rough grinding wheel until a preset stock amount for finish grinding remains, and then the finish grinding process finish grinds the stock amount while the workpiece W is continuously supported by the supporting device. The stock amount for finish grinding is set based on at least one of a thermal displacement of the multifunction grinding machine and a changing amount of grinding force of the rough grinding wheel. A profile remaining the stock amount for finish grinding is a profile not depending on a profile of the rough grinding wheel.

7 Claims, 7 Drawing Sheets

EMBODIMENT

(56) References Cited

U.S. PATENT DOCUMENTS

| | | | | |
|---|---|---|---|---|
| 5,355,633 | A * | 10/1994 | Ishikawa et al. | 451/5 |
| 5,392,566 | A * | 2/1995 | Wedeniwski | 451/5 |
| 5,562,523 | A * | 10/1996 | Asano et al. | 451/1 |
| 5,899,797 | A * | 5/1999 | Junker | 451/62 |
| 6,200,200 | B1 * | 3/2001 | Himmelsbach | 451/62 |
| 6,409,573 | B1 * | 6/2002 | Mukai et al. | 451/5 |
| 6,511,364 | B2 * | 1/2003 | Ido et al. | 451/10 |
| 6,811,465 | B1 * | 11/2004 | Mavro-Michaelis | 451/5 |
| 6,979,247 | B1 * | 12/2005 | Ido | 451/8 |
| 7,153,194 | B2 * | 12/2006 | Mavro-Michaelis | 451/11 |
| 2002/0155790 | A1 * | 10/2002 | Ido et al. | 451/9 |
| 2005/0032466 | A1 * | 2/2005 | Mavro-Michaelis | 451/49 |
| 2007/0178808 | A1 * | 8/2007 | Himmelsbach | 451/11 |
| 2009/0258576 | A1 | 10/2009 | Mizutani et al. | |

FOREIGN PATENT DOCUMENTS

| | | | |
|---|---|---|---|
| JP | 2002-172513 | A | 6/2002 |
| JP | 2006-305709 | A | 11/2006 |
| JP | 2009-95911 | A | 5/2009 |
| JP | 2009-208218 | A | 9/2009 |
| WO | WO 2004/069472 | A1 | 8/2004 |

OTHER PUBLICATIONS

Notification of Reason(s) for Refusal issued Jul. 1, 2014 in Japanese Patent Application No. 2010-241158 (submitting partial English language translation only).

Extended European Search Report issued Aug. 4, 2014 in Patent Application No. 11186728.9.

* cited by examiner

EMBODIMENT

FIRST EXAMPLE

SECOND EXAMPLE

| | UNIT/ DIAMETER | EMBODIMENT | | FIRST EXAMPLE | | SECOND EXAMPLE | |
|---|---|---|---|---|---|---|---|
| | | ROUGH GRINDING | FINISH GRINDING | ROUGH GRINDING | FINISH GRINDING | ROUGH GRINDING | FINISH GRINDING |
| REMOVED AMOUNT | mm(Φ) | 2.9 | 0.1 | 2.5 | 0.5 | 2.3 | 0.7 |
| TOTAL REMOVED AMOUNT | mm(Φ) | 3.0 | | 3.0 | | 3.0 | |
| COST RATE RATIO | 1/mm(Φ) | 1 | 8 | 1 | 8 | 1 | 8 |
| COST RATIO | | 2.9 | 0.8 | 2.5 | 4.0 | 2.3 | 5.6 |
| TOTAL COST RATIO | | 3.7 | | 6.5 | | 7.9 | |

Fig. 7

GRINDING METHOD, GRINDING SYSTEM AND MULTIFUNCTION GRINDING MACHINE

INCORPORATION BY REFERENCE

The present application claims priority under 35 U.S.C. §119 to Japanese Patent Applications No. 2010-241141, filed on Oct. 27, 2010 and Japanese Patent Applications No. 2010-241158, filed on Oct. 27, 2010. The content of these applications is incorporated herein by reference in the entirety.

BACKGROUND OF THE INVENTION

1. Field of the Invention

The present invention relates to a grinding method including a rough grinding process and a finish grinding process, and a grinding system and a multifunction grinding machine executed by the grinding method.

2. Description of the Related Art

It is disclosed in U.S. Pat. No. 5,392,566 that a multifunction grinding machine has a curved concave surface machined by a rough grinding wheel with a large diameter and a finish grinding wheel with a small diameter.

Since the U.S. Pat. No. 5,392,566 discloses that the rough grinding is executed by the large diameter of the rough grinding wheel and the finish grinding is executed by the small diameter of the finish grinding wheel, a removed amount for finish grinding in the curved concave surface of a workpiece is larger than that in remaining portion except for the curved concave surface after rough grinding by the rough grinding wheel. Therefore, it tends to make a variable grinding force by the finish grinding wheel in accordance with a rotational phase of the workpiece. Especially for a cam profile of a camshaft there is a larger removed amount for finish grinding in the curved concave surface than the removed amount for finish grinding in other portion from the curved concave surface, therefore it tends to make large grinding force in the curved concave surface of the cam profile. This causes a shorter life of the finish grinding wheel and a longer time in the finish machining process.

In general, a removed volume per time by the finish grinding is smaller than that by the rough grinding. Therefore, it is desirable that it executes the rough grinding by the rough grinding wheel more time as much as possible and the finish grinding by the finish grinding wheel less time as little as possible. However, there is some restriction by a machine construction or a cycle time of the machining line to decide the individual removed volume by the rough grinding wheel and the finish grinding wheel. Thereby it should increase the removed volume by the finish grinding wheel, so that the life of the finish grinding wheel is ceased faster than that of the rough grinding wheel. As a result, cost for the finish grinding wheel is increased.

SUMMARY OF THE INVENTION

In view of the previously mentioned circumstances, it is an object of the present invention to provide a grinding method, a grinding system and a multifunction grinding machine extending a life of a finish grinding wheel and shortening a grinding time for a finish grinding process.

It is another object of the present invention to provide the grinding method, the grinding system and the multifunction grinding machine reducing a cost for the finish grinding wheel by reducing a grinding volume by the finish grinding wheel as much as possible.

In order to achieve the above and other objects, one aspect of the present invention provides a grinding method of a multifunction grinding machine having a rough grinding wheel and a finish grinding wheel mainly including steps of executing a rough grinding process grinding a workpiece supported by a supporting device by the rough grinding wheel until a preset stock amount for finish grinding (also sometimes referred to a a removed amount for finish grinding) remains, and executing a finish grinding process grinding the stock amount for finish grinding of the workpiece continuously supported by the supporting device by said finish grinding wheel after the rough grinding process, the stock amount for finish grinding is set based on at least one of a thermal displacement of the multifunction grinding machine and a changing amount of grinding force of the rough grinding wheel, a profile remaining the stock amount for finish grinding is a profile not depending on a profile of the rough grinding wheel. Thereby, the multifunction grinding machine can make a process concentration of the multifunction grinding including the rough grinding by the rough grinding wheel and the finish grinding by the finish grinding wheel. It eliminates any phase errors of mounting and re-mounting the workpiece between the rough grinding process and the finish grinding process. Thereby, the multifunction grinding machine can reduce the errors of mounting and re-mounting and a stock amount for the finish grinding.

The removed amount for the finish grinding according to the first aspect of the present invention is set based on at least one of thermal displacement of the multifunction grinding machine and changing amount of grinding force based on the rough grinding wheel, and the profile remaining the removed amount for finish grinding is a profile not depending on a profile of the rough grinding wheel. In other words, the removed amount for the finish grinding is set independently from the profile of the rough grinding wheel and based on at least one of thermal displacement of the multifunction grinding machine and changing amount of grinding force based on the rough grinding wheel. Therefore, it can reduce the removed amount for the finish grinding.

Therefore, the grinding method according to the present invention can achieve to minimize the removed amount for the finish grinding by the way of not only reducing the removed amount for the finish grinding by eliminating to remove and re-mount the workpiece with the process concentration of the multifunction grinding, but also reducing the removed amount for the finish grinding by the above-identified setting method of the removed amount for the finish grinding. As a result, it can extend the life of the finish grinding wheel and reduce the cost for the finish grinding wheel.

The second aspect of the present invention includes mainly the steps of preparing a plurality of the multifunction grinding machines between one previous process and one next process in a manufacturing line, executing a rough grinding and a finish grinding in turn by each of the plural multifunction grinding machines to grind the workpiece transferred from the previous process, and transferring the workpiece to the next process in the manufacturing line after the finish grinding, each of the multifunction grinding machines executes in parallel between the previous process and the next process.

Where the workpiece transferred from the previous process is transferred to the next process after the rough and the finish grinding in a prior manufacturing line, there are equipped one grinding machine only for the rough grinding machine and the other grinding machine only for the finish grinding machine. As explained later in first example as reference, a machining condition of each of the grinding machines is set in a way that both of a grinding time by the one grinding machine in the rough grinding process and a grinding time by the other grinding machine in the finish grinding process are set within a cycle time of the manufacturing line. Based on this machining condition the finish grinding by the other grinding machine tends to be set too much, thereby to reduce the life of the finish grinding wheel.

According to the second aspect of the present invention, each of the multifunction grinding machines independently each other executes the rough machining process and the finish machining process because the plural multifunction grinding machines are positioned in parallel between the previous process and the next process. Therefore, it can make the removed amount for the finish grinding minimum and extend the life of the finish grinding wheel, so that it can reduce the cost for the finish grinding wheel.

Since the plural multifunction grinding machines according to the present invention are operated in parallel, a time divided the grinding time of each of the plural multifunction grinding machines by a number of the multifunction grinding machine is a total time of the rough grinding process and the finish grinding process per one workpiece. Each of the multifunction grinding machines has merit of shortened time without removing and re-mounting the workpiece from the rough grinding to the finish grinding. The time divided the grinding time of each of the plural multifunction grinding machines by a number of the multifunction grinding machine according to the present invention can be reduced extremely compared to the grinding machines for only rough grinding and finish grinding. Thereby, the present invention can reduce the cycle time for the manufacturing line.

The third aspect of the present invention provides mainly a cam of a camshaft as the workpiece, and the removed amount for finish grinding being set based on further grinding errors of a cam profile of the camshaft in accordance with bending of the workpiece or the multifunction grinding machine.

In general, where a cam profile is ground the cam profile is represented by a rotational phase and an amount of a lift of the cam. Bending is generated in the workpiece or parts of the multifunction grinding machine by the grinding force. The cam profile is preset in the condition that there is no generation of the bending. An outer diameter after grinding is larger than a target diameter because of the bending where the ground portion of the workpiece W is the surface of a cylindrical form having the uniform radius. Because of this phenomenon a sparkout grinding is executed in cylindrical grinding. The grinding wheel should be moved along an X-axis direction in accordance with the rotational phase of the camshaft where it grinds the outer peripheral surface of the cam of the camshaft. The grinding errors of the cam profile of actually ground profile from an ideal cam profile is generated because of the generated bending where the outer surface of the cam, not having the uniform radius but having the variable distance from the center axis of the camshaft, is ground. The grinding error of the cam profile is generated along an infeed direction of the grinding wheel by the changeable grinding force due to the variable distance. Therefore, the removed amount for the finish grinding according to the third aspect of the present invention is preset by considering the grinding errors of the cam profile. By this construction, the present invention can exclude any possible grinding errors of the cam profile in the finish grinding, thereby to eliminate any affection of the grinding errors of the cam profile to the workpiece ground by the finish grinding wheel.

The fourth aspect of the present invention provides the workpiece including on its outer peripheral surface a curved concave surface having a radius R1 of curvature, each of a radius R2 of the rough grinding wheel and a radius R3 of the finish grinding wheel is formed to be smaller than the radius R1 of curvature of the curved concave surface.

The radius R2 of the rough grinding wheel is set to be smaller than the minimum value R1 of the radius of curvature of the curved concave surface. By this physical construction the rough grinding wheel will be able to grind the outer peripheral surface of the cam to the final finish profile theoretically. In this case there were no removed amount for the finish grinding by the finish grinding wheel. In the actual grinding, the rough grinding wheel does not grind to the final finish profile where the removed amount for the finish grinding is zero. In other words, the profile having the removed amount for the finish grinding at the outer peripheral surface of the cam can be a profile that does not depend on the profile of the rough grinding wheel. Therefore, the removed amount for the finish grinding has same amount at the portion of the curved concave surface and the remaining portion except for the curved concave surface. The present invention can make the removal amount for the finish grinding minimum independently from the profile of the rough grinding wheel when the cam profile having the curved concave surfaces are ground.

The removed amount for the finish grinding can have same amount at the portion of the curved concave surface and the remaining portion except for the curved concave surface. Thereby, the fourth aspect of the present invention can execute the finish grinding process without changing the grinding force by the finish grinding wheel at any rotational phase of the workpiece. Therefore, it extends the life of the finish grinding wheel and shortens the time for the finish grinding process. The radius R3 of the finish grinding wheel is set to be smaller than the minimum value R1 of the radius of curvature of the curved concave surface, thereby the present invention can grind the workpiece to the final finished profile positively.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 7 is a chart showing a tool cost in the present invention, first example for reference and second example for reference.

DETAILED DESCRIPTION OF THE PREFERRED EMBODIMENTS

"Construction of Multifunction Grinding Machine"

Figure 1:
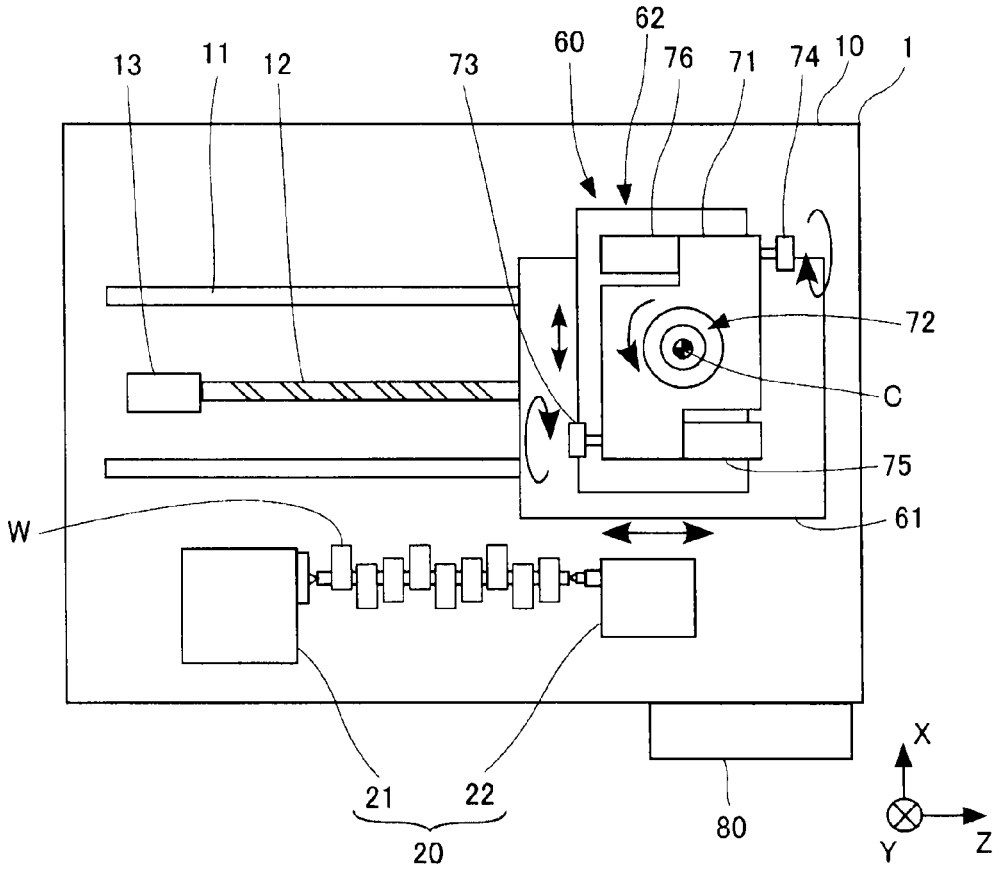
FIG. 1 is a plan view of a multifunction grinding machine according to the present invention.

A preferred embodiment of a grinding method, a grinding system and a multifunction grinding machine according to the present invention will be described in referring to FIG. 1 to FIG. 4. A multifunction grinding machine 1 is explained here for example as a type of a traversing wheel head. The multifunction grinding machine 1 includes a bed 10, a supporting device 20, a grinding wheel supporting device 60 and a controller 80.

The bed 10 is formed to a nearly rectangular shape and fixed on a floor. On an upper surface of the bed 10 are formed a pair of guide rails 11 in parallel each other along a right and left direction in FIG. 1 of a Z-axis on which the grinding wheel supporting device 60 are slideable. On the bed 10 is mounted a Z-axis ball screw 12 driving the grinding wheel supporting device 60 along the right and left direction in FIG. 1 between the pair of guide rails 11 and a Z-axis driving motor 13 is mounted on the bed 10 for driving the Z-axis ball screw 12.

The supporting device 20 supports a workpiece W rotatably. The workpiece W is a camshaft and a ground portion of the workpiece W is an outer peripheral surface of a cam profile. The supporting device 20 supports both ends of the camshaft as the workpiece W for preparing the camshaft to be rotated around an axis of the camshaft. The supporting device 20 includes a spindle head 21 supporting one end of the camshaft and a tail stock 22 supporting another end of the camshaft. The supporting device 20 is mounted on the upper surface of the bed 10 in front of the guide rails 11 so as to make an axis of the camshaft parallel to the Z-axis.

The grinding wheel supporting device 60 includes wheel slide traversing base 61 and a multifunction wheel slide 62. The wheel slide traversing base 61 is a rectangular plate and is mounted slideably on the guide rails 11 on the bed 10 along the Z-axis direction. The wheel slide traversing base 61 is connected to a nut member of the Z-axis ball screw 12 and is fed in traversing by a driving of the Z-axis motor 13 along the guide rails 11. On an upper surface of the wheel slide traversing base 61 are mounted the multifunction wheel slide 62 slideable on an un-illustrated pair of guide rails equipped along X-axis direction, up and down direction in FIG. 1. An un-illustrated X-axis ball screw is equipped to drive the multifunction wheel slide 62 along the X-axis on the wheel slide traversing base 61. An un-illustrated X-axis motor is equipped to drive the X-axis ball screw.

The multifunction wheel slide 62 includes a wheel slide body 71, a wheel slide swivel mechanism 72, a rough grinding wheel 73, a finish grinding wheel 74 and grinding wheel driving motors 75, 76. The wheel slide body 71 is mounted slidealby on the X-axis guide rails on the upper surface of the wheel slide traversing base 61.

The wheel slide body 71 is connected to a nut member of the X-axis ball screw and moved along the X-axis guide rails by driving of the X-axis motor. Therefore, the wheel slide body 71 is movable relatively to the camshaft supported by the supporting device 20 along the X-axis and the Z-axis directions. The wheel slide body 71 is rotatably supported around a Y-axis, a normal axis to a surface of FIG. 1, by the wheel slide swiveling mechanism 72 relatively to the wheel slide traversing base 61. A swivel axis C of the wheel slide swiveling mechanism 72 is positioned near a center portion of the wheel slide traversing base 61. On outer sides of the wheel slide body 71 around the swivel axis C are mounted the rough grinding wheel 73 and the finish grinding wheel 74 rotatably around horizontal axes respectively. The rough grinding wheel 73 is a circular plate having a radius R2 and is suitable for the rough grinding. The finish grinding wheel 74 is a circular plate having a radius R3 and is suitable for the finish grinding process, where the radius R3 is equal to the radius R2 in the embodiment of the present invention. The finish grinding wheel 74 is mounted at an axisymmetric point of the swivel axis C from a position of the rough grinding wheel 73. Therefore, the rough grinding wheel 73 and the finish grinding wheel 74 are selectively used by swiveling the wheel slide body 71. On the wheel slide body 71 are mounted grinding wheel rotating motors 75, 76 for rotating the rough grinding wheel 73 and the finish grinding wheel 74 respectively.

The controller 80 controls numerically a rotation of a spindle, an X-axis position and a Z-axis position of the multifunction wheel slide 62, and a swiveling angle of the multifunction wheel slide 62. The controller 80 controls to rotate one of the grinding wheel rotating motors 75, 76 to rotate one of the rough grinding wheel 73 and the finish grinding wheel 74 for grinding the workpiece W actually. By the controller 80 the multifunction grinding machine grinds the outer peripheral surface of the camshaft as the workpiece W by controlling the X-axis position and the Z-axis position of the multifunction wheel slide 62 during rotating one of the rough grinding wheel 73 and the finish grinding wheel 74 after the multifunction wheel slide 62 is positioned by the wheel slide swiveling mechanism 72.

The multifunction grinding machine 1 can make a process concentration of the multifunction grinding including the rough grinding by the rough grinding wheel 73 and the finish grinding by the finish grinding wheel 74. It eliminates any phase errors of mounting and re-mounting the camshaft as the workpiece W because the camshaft is not mounted nor re-mounted to and from the supporting device 20 between the rough grinding process and the finish grinding process. Therefore, the multifunction grinding machine can reduce a removed amount for the finish grinding by the finish grinding wheel 74 because there is not the phase error.

"Profile of the Outer Cam Surface of the Camshaft and the Grinding Wheels"

Referred to FIG. 2, it will be explained the outer peripheral surface of the cam of the camshaft as the workpiece W, and the rough grinding wheel 73 and the finish grinding wheel 74. The outer peripheral surface of the cam of the camshaft includes two curved concave surfaces W1, W2, a base circle portion W3 and a top circle portion W4 as shown by a solid line in FIG. 3. The two curved concave surfaces W1, W2 are located between the base circle portion W3 and a top circle portion W4. The base circle portion W3 has a portion of a cylindrical shape having a uniform radius, that is to say a uniform distance from the center axis of the camshaft and each of the two curved concave surfaces W1, W2 is a non-circle having variable distance from the center axis of the camshaft. R1 is a minimum amount of the radius of curvature of the two curved concave surfaces W1, W2.

Figure 2:
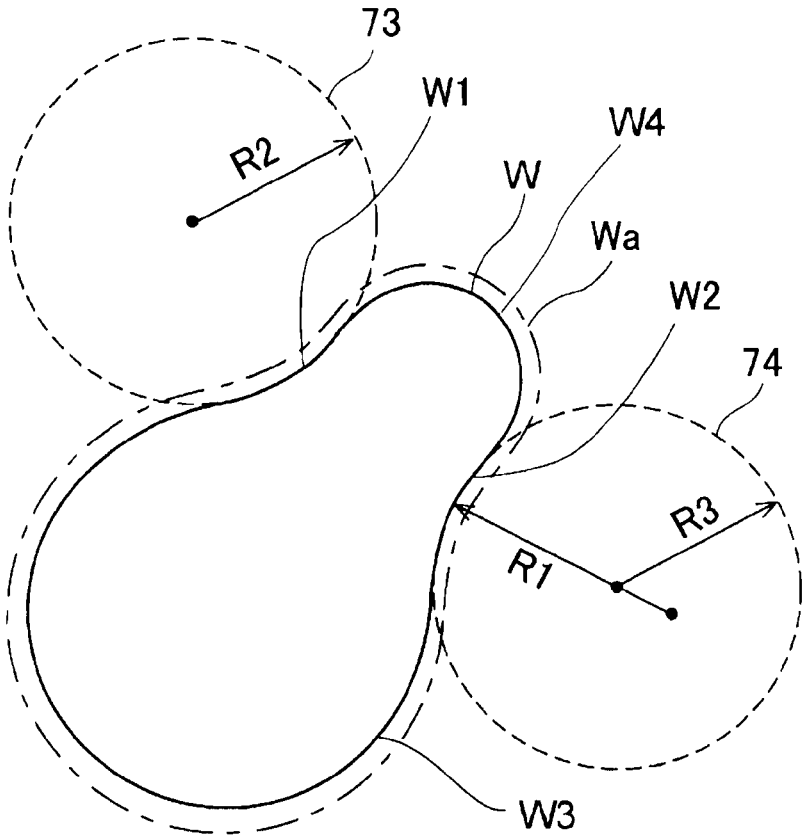
FIG. 2 is a view of a ground portion of a workpiece from an axial direction and showing a rough grinding wheel and a finish grinding wheel compared with each other according to the present invention.

A dashed line in FIG. 2 shows the profile Wa of the camshaft, the outer peripheral surface of the cam of which have been finished to be ground by the rough grinding wheel 73. The profile Wa shown by the dashed line is a profile for a ground portion by the finish grinding wheel 74. Therefore, the removed amount for the finish grinding by the finish grinding wheel 74 is an amount of a difference between the profile Wa shown by the dashed line and a final finish profile W shown by the solid line.

The radius R2 of the rough grinding wheel 73 and the radius R3 of the finish grinding wheel 74 are set to be smaller than the minimum value RI of the radius of curvature of the two curved concave surfaces W1, W2. By this physical construction the rough grinding wheel 73 will be able to grind the outer peripheral surface of the cam to the final finish profile W theoretically. In this case there were no stock amount for the finish grinding by the finish grinding wheel 74. In the actual embodiment of the present invention the rough grinding wheel 73 does not grind to the final finish profile W where the stock amount for the finish grinding is zero.

In other words, the profile Wa having the removed amount for the finish grinding at the outer peripheral surface of the cam shown by the dashed line in FIG. 2 can be a profile that does not depend on the profile of the rough grinding wheel 73. Therefore, the removed amount for the finish grinding has same amount at the portion of the two curved concave surfaces W1, W2 and the remaining portion except for the two curved concave surfaces W1, W2. The grinding method, the grinding system and the multifunction grinding machine according to the present invention can make the removal amount for the finish grinding minimum independently from the profile of the rough grinding wheel 73 when the cam profile having the two curved concave surfaces W1, W2 are ground.

The radius R2 of the rough grinding wheel 73 is equal to the radius R3 of the finish grinding wheel 74 in one example of the embodiment. The radius of the finish grinding wheel 74 is smaller than the two curved concave surfaces W1, W2, thereby to grind steadily to the final finish profile by the finish grinding wheel 74.

"Setting Method of the Removed Amount for the Finish Grinding"

It will be explained hereinafter the setting method of the removed amount for the finish grinding by the finish grinding wheel 74. The removed amount for the finish grinding is a portion ground by the finish grinding wheel 74 in the finish grinding process and the remaining portion after grinding by the rough grinding wheel 73 in the rough grinding process.

The profile Wa for the finish grinding is independent from the profile of the rough grinding wheel 73. Therefore, the removed amount for the finish grinding can be set independently from the profile of the rough grinding wheel 73. In addition, there is no need for the removed amount for the finish grinding to provide possibility of possible amount of mounting errors by removing and re-mounting the workpiece. The removed amount for the finish grinding is preset based on next three items; thermal displacement of the multifunction grinding machine 1, variable amount of grinding force based on the rough grinding wheel 73, and grinding errors of the cam profile of the outer peripheral surface of the camshaft as the workpiece W.

In detail, where the workpiece W is a cylindrical shape having the uniform radius, the removed amount for the finish grinding is preset based on at least one of the thermal displacement of the multifunction grinding machine 1 and the variable amount of the grinding force based on truing interval for the rough grinding wheel 73. The thermal displacement of the multifunction grinding machine 1 is based on displacement of the machine itself by thermal changing explained in detail hereinafter. Where the workpiece W is the camshaft, the removed amount of the profile for the finish grinding of the base portion W3 is preset based on at least one of the thermal displacement of the multifunction grinding machine 1 and the variable amount of grinding force based on the rough grinding wheel 73 because the base portion W3 has the uniform radius same to the cylindrical workpiece. Where the workpiece W is the camshaft, the removed amount for the finish grinding of the whole portion of the camshaft including two curved concave surfaces W1, W2, the base circle portion W3 and the top circle portion W4 is preset based on the thermal displacement of the multifunction grinding machine, the variable amount of grinding force based on the rough grinding wheel 73 and grinding errors of the cam profile of the outer peripheral surface of the camshaft as the workpiece W based on bending of the workpiece or the multifunction grinding machine, explained in detail hereinafter.

Where there happens thermal displacement of the multifunction grinding machine 1, a relative distance between the rough grinding wheel 73 and the ground portion of the camshaft as the workpiece W is changed. The removed amount by the rough grinding wheel 73 is changeable in accordance with the amount of the thermal displacement of the multifunction grinding machine 1. Therefore, the removed amount for the finish grinding is set by considering the amount of the thermal displacement of the multifunction grinding machine 1.

The changeable amount removed by the rough grinding wheel 73 is due to sharpness of the rough grinding wheel 73. The sharpness of the grinding wheel is changeable in comparison of the sharpness just after being dressed or trued the grinding wheel with the sharpness after grinding a lot of workpieces after dressing or truing. The removable amount by the grinding wheel is changeable in accordance with the truing interval having the changed sharpness even though in same grinding conditions. Therefore, the grinding force is changed by changing the sharpness of the grinding wheel even though in same grinding conditions, thereby to set the removed amount for the finish grinding by considering the changed amount of the grinding force on a basis of the rough grinding wheel 73.

Figure 3:
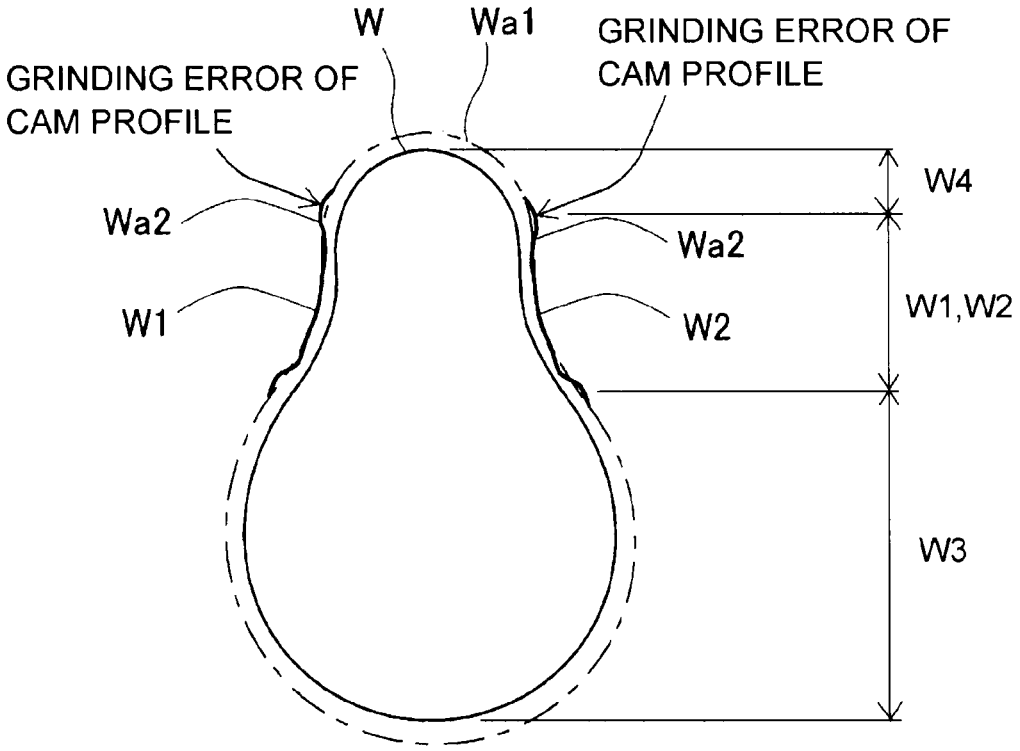
FIG. 3 is a view of a ground portion of a workpiece from an axial direction and showing a cam profile and a grinding error of the cam profile according to the present invention.

Grinding error of the cam profile will be explained referred to FIG. 3. A solid line shows the final finished profile W in a state finally ground by the finish grinding wheel 74 and the dashed line shows the profile Wa1 in a state finally ground by the rough grinding wheel 73. The profile Wa1 shown by the dashed line is a profile for a ground portion by the finish grinding wheel 74. The cam profile is represented by a rotational phase and a lift amount of the camshaft as the workpiece W. The cam profile is a commanded value from the controller 80. It is usual that there happen errors of ground profile of the cam in relative to an ideal profile of the cam in grinding the camshaft as the workpiece W by driving each part in the multifunction grinding machine 1 in accordance with the commanded value. The errors are identified as the grinding error of the cam profile.

Bending is generated in the workpiece W or each part of the multifunction grinding machine 1 by the grinding force. The cam profile is preset in the condition that there is no generation of the bending. An outer diameter after grinding is larger than a target diameter because of the bending where the ground portion of the workpiece W is the surface of a cylindrical form having the uniform radius. Because of this phenomenon a sparkout grinding is executed in cylindrical grinding.

The rough grinding wheel 73 should be moved along an X-axis direction in accordance with the rotational phase of the camshaft where it grinds the outer peripheral surface of the cam of the camshaft. The grinding errors of the cam profile of actually ground profile Wa2 from the cam profile Wa1 is generated because of the generated bending where the outer surface of the cam, not having the uniform radius but having the variable distance from the center axis of the camshaft, is ground. The grinding error of the cam profile is generated along an infeed direction of the grinding wheel by the changeable grinding force due to the variable distance. Therefore, the removed amount for the finish grinding is preset by considering the grinding errors of the cam profile. The ground profile Wa2 is shown partially in FIG. 3 and un-illustrated portions are same to the corresponding portions of the profile Wa1 of the cam.

As explained above the grinding method, the grinding system and the multifunction grinding machine according to the present invention can achieve to minimize the removed amount for the finish grinding because of presetting the removed amount for the finish grinding independently from the profile of the rough grinding wheel 73 in addition to reduce the removed amount for the finish grinding by eliminating to remove and re-mount the workpiece W by the multifunction grinding. Thereby it can improve the life of the finish grinding wheel and reduce the cost for the finish grinding wheel.

"Grinding System in Machining Line"

Figure 4:
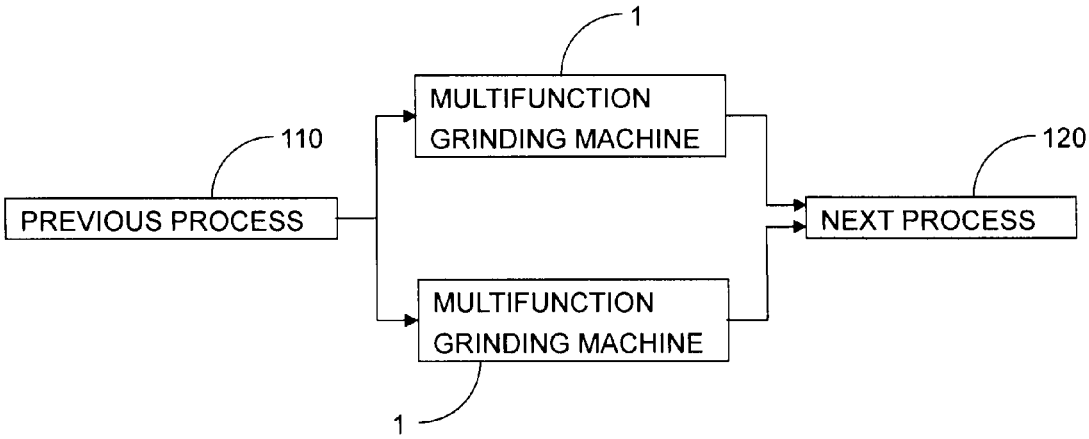
FIG. 4 is a construction diagram of a manufacturing line according to the present invention.

The grinding system in the machining line according to the present invention will be explained hereinafter referred to FIG. 4. The machining line is a line machining the camshaft as the workpiece W. Only the multifunction grinding machine 1 is explained in the machining line. Processes in the multifunction grinding machine 1 in the machining line are identified the grinding system.

The machining line for the camshaft as the workpiece W includes between one previous process 110 and one next process 120 two multifunction grinding machines 1 of the rough machining process and the finish machining process grinding the peripheral surface of the camshaft. Therefore, the grinding system has double multifunction grinding machines 1. The reason why it equips one previous process 110 and one next process 120 is to identify the case transferring each camshaft as the workpiece W from the previous process 110 to each of the grinding processes and to transfer one camshaft from each of the grinding processes to the next process 120.

The plural multifunction grinding machines 1 operate independently each other in parallel between the previous process 110 and the next process 120. Each of multifunction grinding machines 1 executes same grinding process each other. Each of multifunction grinding machines 1 executes the rough machining process and the finish machining process in turn for the camshaft as the workpiece W transferred into the machine, and the transfer to the rough machined workpiece W to the next process 120 after the rough grinding.

Where the first workpiece W is transferred from the previous process 110, one multifunction grinding machine 1 executes the rough machining process and the finish grinding process and then transfers to next process 120. Where the second workpiece W is transferred from the previous process 110, the other multifunction grinding machine 1 executes the rough machining process and the finish machining process and then transfers to next process 120. After that each process is repeated. Thereby, it can reduce the cost for the finish grinding wheel 74 and reduce a cycle time of the machining line, explained hereinafter in detail.

"First Example as a Reference"

The first example as the reference against the grinding method and the multifunction grinding machine will be explained referred to FIG. 5. The grinding machine of the first example is not the multifunction grinding machine 1 of the embodiment of the present invention but a grinding machine having single grinding wheel, in other words one grinding wheel.

Figure 5:
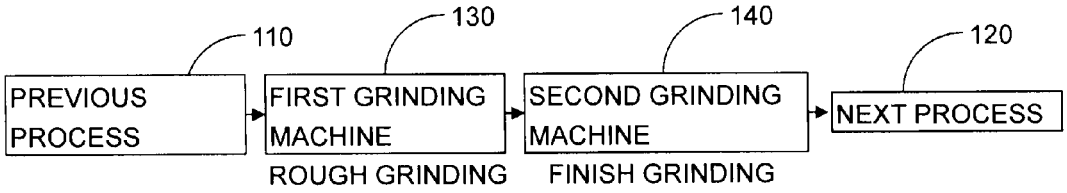
FIG. 5 is a construction diagram of a manufacturing line according to first example as reference.

The grinding system in the first example as the reference includes first grinding machine 130 having the rough grinding wheel 73 and second grinding machine 140 having the finish grinding wheel 74 in turn between the previous process 110 and the next process 120 as shown in FIG. 5. The first grinding machine 130 executes only the rough grinding by the rough grinding wheel 73. The second grinding machine 140 executes only the finish grinding by the finish grinding wheel 74. A radius of the rough grinding wheel 73 is R2, a radius of the finish grinding wheel 74 is R3 and each of radiuses R1, R2 is set to be smaller than the minimum value R1 of the radius of curvature of two curved concave surfaces W1, W2 at the outer peripheral surface of the cam of the camshaft. A cycle time of the first example as the reference is longer than that of the embodiment of the present invention. But the cycle time of the first example as the reference is shorter than that of the prior grinding machine having the larger radius of the rough grinding wheel than the minimum value R1 of the radius of curvature of two curved concave surfaces W1, W2.

"Second Example as a Reference"

In concerning about comparing the tool cost and the cycle time of the embodiment according to the present invention, the multifunction grinding machine disclosed in the U.S. Pat. No. 5,392,566 will be explained as the second example as the reference. The machining line in the second example as the reference will be assumed to include the same machining line to the embodiment of the present invention by replacing the multifunction grinding machine disclosed in the above-identified U. S. Patent to the multifunction grinding machine 1 of the embodiment. The radius of the rough grinding wheel is preset to be larger than the minimum value R1 of the radius of curvature of two curved concave surfaces W1, W2 and the radius of the finish grinding wheel is preset to be smaller than the minimum value R1 of the radius of curvature.

"Comparison of the Embodiment to First and Second Example as the Reference"

Figure 6A:
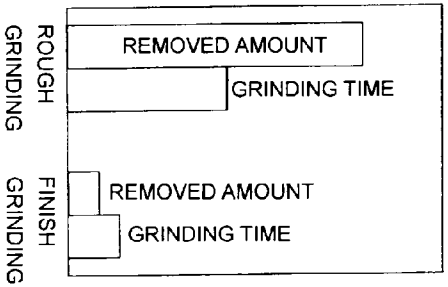
FIG. 6A is a graph showing a removed amount and a grinding time for each process according to the present invention.
Figure 6B:
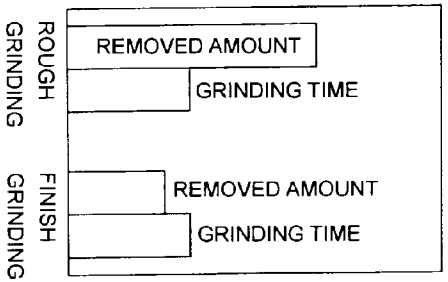
FIG. 6B is a graph showing a removed amount and a grinding time for each process according to first example for reference and FIG. 6C is a graph showing a removed amount and a grinding time for each process according to second example for reference.
Figure 6C:
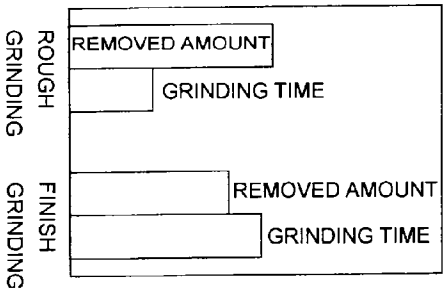

It will be explained here the comparison of the cycle time and the tool cost of the embodiment to those of the first and the second examples as the reference. FIG. 6A, FIG. 6B and FIG. 6C show removed amount/grinding time by the rough grinding wheel and removed amount/grinding time by the finish grinding wheel for the embodiment, the first example and the second example. The grinding time in each process of the embodiment and the second example is a grinding time for the rough grinding and the finish grinding for one workpiece W by dividing the grinding time by two because there are two multifunction grinding machines. On the other hand, the grinding time in each process of the first example is just grinding time for each corresponding process because each process is executed each different grinding machine.

In comparison of the embodiment to the first example, the embodiment of the present invention has large removed amount for rough grinding, long grinding time of the rough grinding, small removed amount for finish grinding and short grinding time of finish grinding as shown in FIG. 6A and FIG. 6B. In comparison to the first example, the embodiment can therefore remove the much volume of material by rough grinding wheel 73 and can reduce the removed amount for the finish grinding by the finish grinding wheel 74.

A machining condition is set in a way that the grinding time by the first grinding machine 130 in the rough grinding process almost equals to the grinding time by the second grinding machine 140 in the finish grinding process because the first grinding machine 130 is provided independently to the second grinding machine 140 in the first example as the reference. Based on this machining condition the finish grinding by the second grinding machine 140 tends to be set too much compared to the embodiment of the present invention.

In comparison of the first example as the reference to the second example as the reference, the first example as the reference has more removed amount in the rough grinding process, longer grinding time of the rough grinding, less removed amount in the finish grinding process and shorter grinding time in finish grinding as shown in FIG. 6B and FIG. 6C. The first example as the reference compared to the second example as the reference executes the rough grinding by the rough grinding wheel 73 more time as much as possible and the finish grinding by the finish grinding wheel 74 less time as little as possible. This can be executed by grinding at more amounts by the rough grinding wheel 73 by the way that the radius R2 of the rough grinding wheel 73 is set to be smaller than the minimum amount R1 of the radius of curvature of the outer peripheral surface of the cam of the camshaft.

The tool cost is considered in referring to the FIG. 7. FIG. 7 shows tool costs of the embodiment of the present invention, the first example as the reference and the second reference as the reference. The cost rate ratio in FIG. 7 is a ratio of a cost of the rough grinding wheel 73 to a cost of the finish grinding wheel 74 at one millimeter of the removed amount in the diameter. The cost rate ratio of the rough grinding wheel 73 to the finish grinding wheel 74 is 1 to 8 calculated by a number of the workpiece by one piece of the grinding wheel, a cost of the one piece of the grinding wheel, a cost of the grinding wheel for grinding one piece of the workpiece and a removed amount of the one piece of the workpiece. This shows that the cost rate of the rough grinding wheel 73 is one and the cost rate of the finish grinding wheel 74 is eight.

As shown in second line from a bottom the cost ratio of the finish grinding wheel 74 of the embodiment of the present invention is reduced from that in the first example as the reference and reduced extremely from that in the second example as the reference. On the other hands, the cost ratio of the rough grinding wheel 73 of the embodiment of the present invention is increased from that in the first and second examples as the reference but the increased amount of the rough grinding wheel 73 is a little in comparison with the difference of the cost ratio of the finish grinding wheel 74. In comparison of the total cost ratio, therefore, the total cost ratio of the embodiment is largely reduced from that of the first example as the reference and extremely largely reduced from that of the second example as the reference.

While the invention has been described in detail with reference to the preferred embodiment, it will be apparent to those skilled in the art that the invention is not limited to the present embodiment, and that the invention may be realized in various other embodiments within the scope of the claims.

For example, while the multifunction grinding machine is the traverse type having the grinding wheel supporting device 60 moved for the traverse and the workpiece supported by the supporting device 20 is fixed relatively to the bed 10, however the present invention is not limited to the construction, but it may be applied to a construction that a table mounting the supporting device 20 of the multifunction grinding machine 1 is traversed and the multifunction wheel slide 62 is moved in relative to the bed 10 in X-axis direction only.

While the embodiment is described by the camshaft as the workpiece W and the outer peripheral surface of the cam as the ground portion, however the present invention may be applied for a crank journal of a crankshaft having an outer cylindrical peripheral surface as the ground portion.

What is claimed is:

1. A grinding method for a curved concave surface of a workpiece by a multifunction grinding machine, the multifunction grinding machine having a supporting device supporting a workpiece; a multifunction wheel slide mounted moveably relative to said supporting device and having a rough grinding wheel and a finish grinding wheel, said rough grinding wheel and said finish grinding wheel being selectively used, wherein said workpiece includes on its outer peripheral surface the curved concave surface having a minimum radius R1 of curvature; and each of a radius R2 of said rough grinding wheel and a radius R3 of said finish grinding wheel is formed to be smaller than said minimum radius R1 of curvature of said curved concave surface; and a controller controlling grinding of said workpiece by selecting one of said rough grinding wheel and said finish grinding wheel selected as a grinding wheel; the grinding method comprising the steps of:

executing a rough grinding process of grinding said workpiece supported by said supporting device using said rough grinding wheel until a preset stock amount for finish grinding remains; and executing a finish grinding process of grinding said stock amount for finish grinding of said workpiece continuously supported by said supporting device by said finish grinding wheel after said rough grinding process;

wherein said stock amount for finish grinding is set based on at least one of a thermal displacement of said multifunction grinding machine and a changing amount of a grinding force of said rough grinding wheel; and wherein a profile of the stock amount for finish grinding does not depend on a profile of said rough grinding wheel.

2. A grinding method by said multifunction grinding machine according to claim 1, further comprising:

preparing a plurality of said multifunction grinding machines between a previous process and a next process in a manufacturing line;

executing a rough grinding and a finish grinding in turn by each of said plural multifunction grinding machines to grind said workpiece transferred from said previous process; and transferring said workpiece to said next process in said manufacturing line after said finish grinding;

wherein each of said multifunction grinding machines executes grinding in parallel between said previous process and said next process.

3. A grinding method by said multifunction grinding machine according to claim 1, wherein said workpiece is a cam of a camshaft; and said stock amount for finish grinding is set based on further grinding errors of a cam profile of said camshaft in accordance with bending of said workpiece or said multifunction grinding machine.

4. A grinding method by said multifunction grinding machine according to claim 3, wherein said stock amount for finish grinding is set based on a thermal displacement of said multifunction grinding machine, a changing amount of grinding force of said rough grinding wheel and grinding errors of a cam profile of said camshaft in accordance with bending of said workpiece or said multifunction grinding machine.

5. A grinding system for grinding a curved concave surface of a workpiece, comprising:

a supporting device supporting a workpiece, said workpiece is a cam of a camshaft including on its outer peripheral surface the curved concave surface having a minimum radius R1 of curvature;

a multifunction wheel slide mounted moveably relative to said supporting device and having a rough grinding wheel having a radius R2 and a finish grinding wheel having a radius R3;

each of said radius R2 of said rough grinding wheel and said radius R3 of said finish grinding wheel is formed to be smaller than said minimum radius R1 of curvature of said curved concave surface; and a controller controlling grinding of said workpiece by selecting a grinding wheel selected as one of said rough grinding wheel and said finish grinding wheel;

said controller executes a rough grinding process grinding said workpiece supported by said supporting device by said rough grinding wheel until a preset stock amount for finish grinding remains;

said controller further executes a finish grinding process of grinding said stock amount for finish grinding of said workpiece continuously supported by said supporting device by said finish grinding wheel after said rough grinding process; and said stock amount for finish grinding is set based on a thermal displacement of said multifunction grinding machine, a changing amount of grinding force of said rough grinding wheel and grinding errors of a cam profile of said camshaft in accordance with bending of said workpiece or said multifunction grinding machine, and a profile of the stock amount for finish grinding does not depend on a profile of said rough grinding wheel.

6. A grinding system according to claim 5, wherein:

a plurality of said multifunction grinding machines are prepared between a previous process and a next process in a manufacturing line;

said rough grinding process and said finish grinding process are executed in turn by each of said plural multifunction grinding machines to grind said workpiece transferred from said previous process;

said workpiece is transferred to said next process in said manufacturing line after said finish grinding process;

each of said multifunction grinding machines executes grinding in parallel between said previous process and said next process.

7. A multifunction grinding machine for grinding a curved concave surface of a workpiece, comprising:

a supporting device supporting a workpiece;

a multifunction wheel slide mounted moveably relative to said supporting device and having a rough grinding wheel and a finish grinding wheel, said rough grinding wheel and said finish grinding wheel being selectively used; and a controller controlling grinding of said workpiece by selecting one of said rough grinding wheel and said finish grinding wheel;

said controller executes a rough grinding process grinding said workpiece supported by said supporting device by said rough grinding wheel until a preset stock amount for finish grinding remains;

said controller further executes a finish grinding process of grinding said stock amount for finish grinding of said workpiece continuously supported by said supporting device by said finish grinding wheel after said rough grinding process; and said stock amount for finish grinding is set based on at least one of a thermal displacement of said multifunction grinding machine and a changing amount of grinding force of said rough grinding wheel, wherein said workpiece is a cam of a camshaft including on its outer peripheral surface a curved concave surface having a minimum radius R1 of curvature; and each of a radius R2 of said rough grinding wheel and a radius R3 of said finish grinding wheel is formed to be smaller than said minimum radius R1 of curvature of said curved concave surface, wherein:

said stock amount for finish grinding is set based on at least one of a thermal displacement of said multifunction grinding machine, a changing amount of grinding force of said rough grinding wheel and grinding errors of a cam profile of said camshaft in accordance with bending of said workpiece or said multifunction grinding machine.

* * * * *